US005081924A

United States Patent [19]

Ohinata

[11] Patent Number: 5,081,924

[45] Date of Patent: Jan. 21, 1992

[54] MIMEOGRAPHIC PRINTING MACHINE

[75] Inventor: Yoshiharu Ohinata, Toride, Japan

[73] Assignee: Riso Kagaku Corporation, Tokyo, Japan

[21] Appl. No.: 659,947

[22] Filed: Feb. 25, 1991

[30] Foreign Application Priority Data

Mar. 6, 1990 [JP] Japan ..... 2-52773

[51] Int. Cl.[5] ..... B41L 13/00

[52] U.S. Cl. ..... 101/120; 101/116

[58] Field of Search ..... 101/114, 116, 119, 120, 101/117, 118

[56] References Cited

U.S. PATENT DOCUMENTS 2,698,574 1/1955 Dougherty et al. ..... 101/120
3,312,165 4/1967 Storm ..... 101/119
3,332,344 7/1967 Londahl et al. ..... 101/120

FOREIGN PATENT DOCUMENTS 51485 3/1982 Japan ..... 101/119
165282 8/1985 Japan ..... 101/120
228982 10/1986 Japan ..... 101/120
196567 12/1923 United Kingdom ..... 101/120

*Primary Examiner*—Edgar S. Burr
*Assistant Examiner*—Rzn Yan
*Attorney, Agent, or Firm*—Kanesaka and Takeuchi

[57] ABSTRACT

A mimeographic printing machine comprises a cylindrical drum rotatable with a stencil supported thereon, a lower pusher roller located under the cylindrical drum coactive with the cylindrical drum to hold a paper sheet therebetween, an inside pusher roller movably received in the cylindrical drum for pushing the cylindrical drum toward the lower pusher roller, a drive gear drivable for rotation with the cylindrical drum, a support arm pivotally received in the cylindrical drum; an intermediate gear supported on the support arm and meshing with the drive gear, and an inside pusher gear mounted on the drive shaft of the inside pusher roller and meshing with the intermediate gear for pushing, with rotating, the inside pusher roller against the inner circumferential surface of the cylindrical drum.

7 Claims, 5 Drawing Sheets

MIMEOGRAPHIC PRINTING MACHINE

BACKGROUND OF THE INVENTION

1. Field of the Invention

This invention relates to a mimeographic printing machine including a rotary cylindrical drum on which a stencil is to be wound along the outer circumferential surface.

2. Description of the Related Art

A mimeographic printing machine is currently known which includes a rotary cylindrical drum for supporting on its outer circumferential surface a stencil, and a lower pusher roller located under the cylindrical drum for holding a paper sheet between the cylindrical drum and the lower pusher roller to move the paper sheet forwardly during printing. FIG. 5 of the accompanying drawings shows such a mimeographic printing machine which includes an inside pusher roller 101 located inside a rotary cylindrical drum 100. This inside pusher roller 101, which is disclosed such as in co-assigned Japanese Patent Application No. 28553/1988, is located inside the cylindrical drum 100 for pushing the cylindrical drum 100 on the inner circumferential surface thereof to bring the outer circumferential surface of the cylindrical drum 100 against a lower pusher roller 102.

The cylindrical drum 100 is rotatably supported on a stationary center axis 103 to which an attachment plate 104 is fixedly attached inside the cylindrical drum 100. The inside pusher roller 101 is vertically movably attached to the attachment plate 104 via a pair of arms 105, 105 (only one shown) and is engageable with the inner circumferential surface of the cylindrical drum 100. A pair of springs (only one shown) 106, 106 is connected between the attachment plate 104 and each of the arms 105, which rotatably supports the opposite ends of the inside pusher roller 101, and normally urges the inside pusher roller 101 downwardly.

Though there is no illustration in the drawings, this machine has a retainer device for retaining the inside pusher roller 101 in an upper position remote from the cylindrical drum 100 against the bias of the springs 106, 106. When printing, the cylindrical drum 100 is driven for rotation, and the non-illustrated retainer device and the like are activated at a suitable timing; only when a print sheet 107 is supplied to the cylindrical drum 100, the inside pusher roller 101 is pushed against the inner circumferential surface of the cylindrical drum 101 under the bias of the spring 106, 106. At that time, the outer circumferential surface of the cylindrical drum 100 projects outwardly to press the paper sheet 107 against the lower pusher roller 102 so that an original image of the stencil is transferred to the paper sheet 107 with ink supplied from inside the cylindrical drum 100 through the original-image-pattern pores of the stencil.

With the above structure in which the inside pusher roller 101 is pressed against the cylindrical drum 100 by means of the springs 106, the biasing force of the springs 106 normally acts on the joints between the arms 105 and the attachment plate 104 and between the attachment plate 104 and the springs 106. Consequently, the associated parts or elements around the inside pusher roller 101 over which the spring force extends should currently be adequately strong and hence were large in weight, resulting in an increased cost of production. Further, it was very difficult to balance the resiliencies of the two springs 106, 106 at the opposite ends of the inside pusher roller 101 so that the density of print will hardly be uniform in the axial direction of the cylindrical drum 100.

SUMMARY OF THE INVENTION

It is therefore an object of this invention to provide a mimeographic printing machine equipped with a unique pushing mechanism which gives pressing forces to the associated parts or elements around an inside pusher roller only when printing and which can press the inside pusher roller against a cylindrical drum by a uniform force.

According to this invention, there is provided a mimeographic printing machine comprising: a frame: a rotary cylindrical drum for supporting a stencil on an outer circumferential surface thereof and having a perforation for passage of ink, the cylindrical drum being rotatable on the frame with the stencil supported thereon, there being an ink supplying means inside the cylindrical drum; a lower pusher roller rotatably supported on the frame under the cylindrical drum for holding a paper sheet between the lower pusher roller and the cylindrical drum to move the paper sheet forwardly; an inside pusher roller movably received in the cylindrical drum and contacting an inner circumferential surface of the cylindrical drum for pushing the cylindrical drum toward the lower pusher roller; a drive gear adapted to be driven for rotation with the cylindrical drum; a pivotable support arm disposed inside the cylindrical drum; an intermediate gear mounted on the support arm and meshing with the drive gear, the intermediate gear being movable in the rotating direction of the drive gear in response to pivotal movement of the support arm; and an inside pusher gear mounted on a drive gear of the inside pusher roller and meshing with the intermediate gear for pushing, with rotating, the inside pusher roller against the inner circumferential surface of the cylindrical drum.

With this arrangement, when the cylindrical drum and the drive gear are rotated during printing, the intermediate gear meshing with the drive gear moves, with rotating on its own axis, with the support arm in the rotating direction of the cylindrical drum. Since the intermediate gear being moved is normally meshing with the inside pusher gear, the inside pusher gear is pushed downwardly, with rotating on its own axis. As a result, the inside pusher roller operatively connected with the inside pusher gear comes into contact with the inner circumferential surface of the cylindrical drum, with rotating on its own axis.

Preferably the machine also comprises a lock device for locking the inside pusher roller against movement in such a manner that the cylindrical drum and the lower pusher roller are out of contact with each other even when the inside pusher roller is in contact with the inner circumferential surface of the cylindrical drum, the lock device being releasable from the locking of the inside pusher roller during printing.

As a specific example, the lock device includes a lever engageable with an inner pusher lever of the inside pusher roller and extending downwardly therefrom so as to prevent the inside pusher from downward pivotal movement.

In addition, the machine comprises a cam movable in response to the rotation of the cylindrical drum; and a cam follower mounted on the drive shaft of the inside pusher roller and resting on the cam; the relationship between the cam and the cam follower a being such that during non-printing the cam raises the inside pusher roller via the cam follower to bring the lever into and out of engagement with the inside pusher lever. The support arm is pivotally mounted on a center axis of the drive gear.

Furthermore, the machine comprises means for detecting the supply of the paper sheet to produce a detecting signal for releasing the lock device from the locking of the inside pusher roller.

When a trouble arises, the lock device is able to lock the inside pusher roller against movement so as not to contact the inner circumferential surface of the cylindrical drum.

The above and other advantages, features and additional objects of this invention will be manifest to those versed in the art upon making reference to the following detailed description and the accompanying drawings in which a preferred structural embodiment incorporating the principles of this invention is shown by way of illustrative example.

DETAILED DESCRIPTION

The principles of this invention are particularly useful when embodied in a mimeographic printing machine such as shown in FIGS. 1 through 4, generally designated by the numeral 1.

Figure 1:
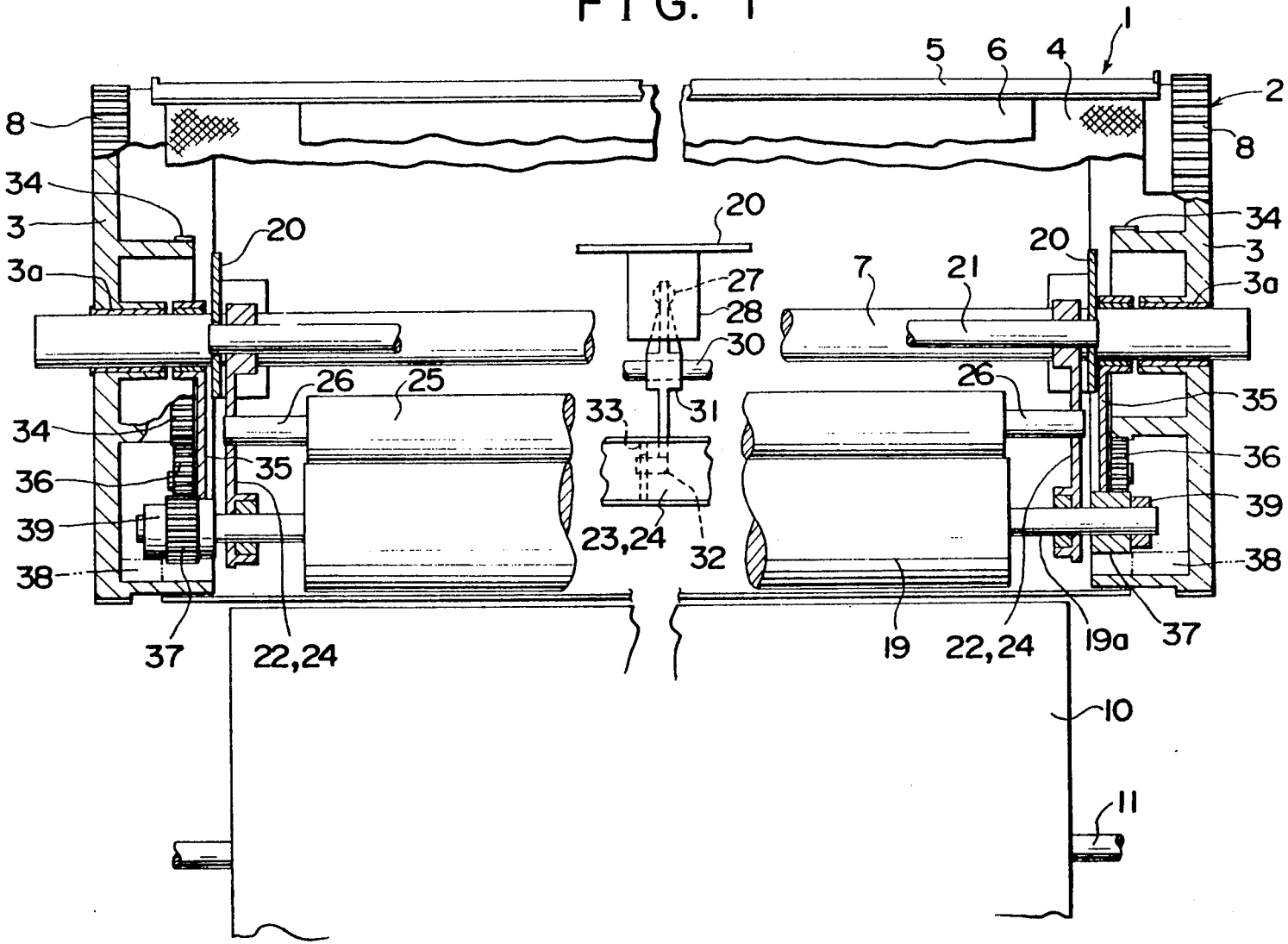
FIG. 1 is a longitudinal cross-sectional view of a mimeographic printing machine embodying this invention.
Figure 2:
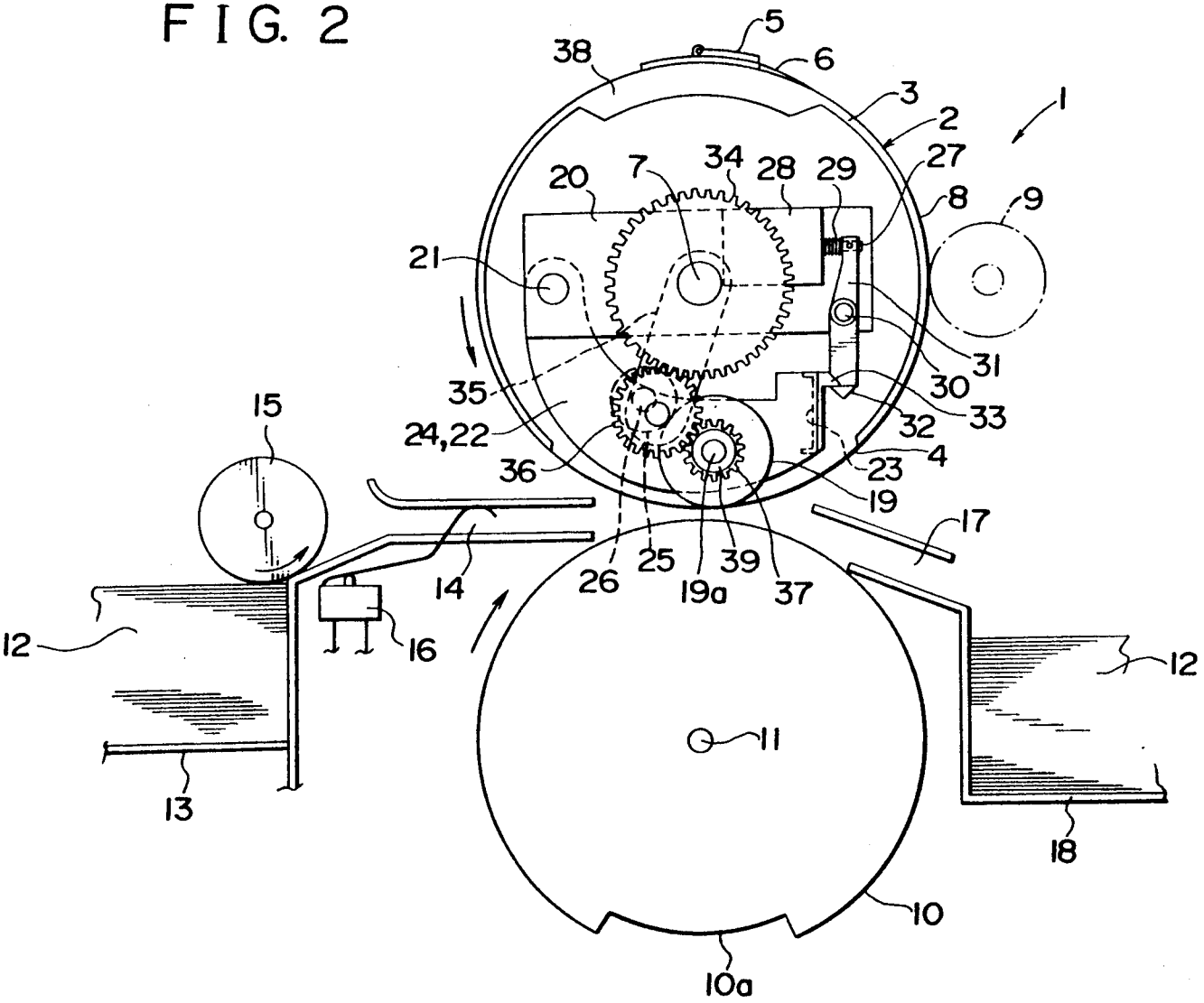
FIG. 2 is a transverse cross-sectional view of FIG. 1.

As shown in FIGS. 1 and 2, reference numeral 2 designates a cylindrical drum whose opposite ends are composed of a pair of annular members 3, 3. A net such as made of a stainless wire in the form of a cylinder extends between the annular members 3, 3 to provide an ink-passing tubular wall 4. A clamp device 5 is mounted on the outer circumferential surface of the tubular wall 4 in parallel to the center axis of the cylindrical drum 2. The clamp device 5 grips a leading end of the stencil 6 to be wound on the outer circumferential surface of the tubular wall 4.

7 designates a main shaft whose opposite ends are fixedly attached to a pair of non-illustrated securing members so as to be aligned with the center axis of the cylindrical drum 2. Specifically, the main shaft 7 extends at opposite ends through the respective center holes 3*a*, 3*a* of the opposite annular members 3, 3 of the cylindrical drum 2. A pair of gears 8, 8 is formed on the outer peripheral surfaces of the respective opposite annular members 3, 3, and drive gears 9 operatively connected with a non-illustrated drive means are meshing with the gears 8, so that the cylindrical drum 2 can be rotated about the main shaft 7 as the driving force of the drive means is transmitted to the gears 8, 8 via the drive gears 9, 9 (only one shown).

A lower pusher roller 10 is located under the cylindrical drum 2 at a predetermined position. The drive shaft 11 of the lower pusher roller 10 extends parallel to the main shaft 7 in such a manner that during non-printing, a gap with a predetermined would be created between the outer circumferential surface of the non-deformed cylindrical drum 2 and the outer circumferential surface of the lower pusher roller 10. The lower pusher roller 10 and the cylindrical drum 2 are rotatable at the same speed in opposite directions, as indicated by arrows in FIG. 2, in synchronism with each other. The lower pusher roller 10 has a groove 10*a* at a position corresponding to the clamp device 5 of the cylindrical drum 2 for receiving the clamp device 5.

As shown in FIG. 2, there are located a paper delivery roller 15 for delivering a paper sheet 12 at a time into a paper feed path 14 and a detector switch 16, which serves as a means for detecting a paper sheet 12 delivered into the paper feed path 14, on the upstream side of both the cylindrical drum 2 and the lower pusher roller 10. On the downstream side of both the cylindrical drum 2 and the lower pusher roller 10, there are located a guide path 17 for guiding a printed paper sheet 12 and a discharge tray 18 for receiving printed paper sheets 12 as successively discharged from the guide path 17.

Inside the cylindrical drum 2, there are located an inside pusher roller 19 for pushing the tubular wall 4 of the cylindrical drum 2 against the lower pusher roller 10, a pusher mechanism for the inside pusher roller 19, a lock device for looking the inside pusher roller 19 in a locked position and for releasing the inside pusher roller 19 in timed relation to the delivery of a paper sheet 12, etc.

Also inside the cylindrical drum 2, a housing 20 to which the associated parts or elements are attached is fixedly secured to the main shaft 7. A pivot 21 parallel to the main shaft 7 is fixedly secured to the rear end of the housing 20. An inside pusher lever 24, in the form of a pair of arcuate arms 22, 22 whose distal ends are connected by a horizontal bar 23, is pivotally attached at the base of each arm 22 to the pivot 21. The drive shaft 19*a* of the inside pusher roller 19 is rotatably supported at opposite ends by the arms 22, 22 of the inside pusher lever 24 for extending parallel to the main shaft 7. A doctor roller 25 also is supported at opposite ends by the arms 22, 22 of the inside pusher lever 24 for contacting the inside pusher roller 19. During printing, ink is supplied to the tangential area between the doctor roller 25 and the inside pusher roller 19 by a non-illustrated ink supply means so that ink is transferred to the inner circumferential surface of the tubular wall 4 of the cylindrical drum 2 via the inside pusher roller 19.

The lock device is supported on the front end of the housing 20 for releasably locking the inside pusher roller 19 against pivotal movement. Specifically, a solenoid 28 with its plunger 27 extending horizontally forwardly is fixedly attached to the front end of the housing 20. The solenoid 28 is electrically connected with the detector switch 16 so that the solenoid 28 is energized to draw the plunger 27 at a predetermined timing with the supply of a paper sheet 12, namely, when the detector switch 16 is ON. And when the detector switch 16 is OFF, the plunger 27 is returned to the original position under the biasing force of a spring 29. A pivot 30 is supported at opposite ends by the front end of the housing 20 in parallel to the main shaft 7, and a solenoid lever 31 is pivotally mounted at its midportion to the central portion of the pivot 30. The solenoid lever 31 is connected at its upper end to the plunger 27 of the solenoid 28 and has at its lower end a hook 32 which is engageable with a claw 33 of the horizontal bar 23 of the inside pusher lever 24 downwardly therefrom.

Inside the cylindrical drum 2, a pushing mechanism composed of a gear train is located for pushing the inside pusher roller 19. On the inner surface of each annular member 3 of the cylindrical drum 2, a drive gear 34 is formed for projecting inwardly in axial alignment with the main shaft 7. A pair of support arms 35, 35 is located each between the annular member 3 and the housing 20 and is each pivotally mounted on the main shaft 7. A pair of intermediate gears 36, 36 is rotatably mounted such that one gear 36 is located on the distal end of each support arm 35, each intermediate gear 36 meshing with the associated drive gear 34. The opposite ends of the drive shaft 19*a* of the inside pusher roller 19 project outwardly from the inside pusher lever 24. An inside pusher gear 37 is fixedly mounted on each of opposite ends of the drive shaft 19*a* of the inside pusher lever 24 to mesh with the respective associated intermediate gear 36.

As the cylindrical drum 2 and the drive gear 34 are driven to rotate, the inside pusher gear 36 meshing with the drive gear 34 is moved toward the inside pusher roller 19 to push the inside pusher gear 37 downwardly, thereby bringing the inside pusher roller 19 into contact with the inner circumferential surface of the tubular wall 4 of the cylindrical drum 2. At that time, the solenoid 28 should be energized to release the hook 32 of the solenoid lever 31 from the claw 33 of the inside pusher lever 24.

A cam 38 is formed on the inner circumferential surface of the flange of each annular member 3 near the clamp device 5 of the cylindrical drum 2. A cam follower 39 is pivotally mounted on each of the opposite ends of the drive shaft 19*a* of the inside pusher roller 19 for resting on the associated cam 38. In the above-described standby position, when the clamp device 5 reaches the printing start position, as shown in FIG. 3, as the cylindrical drum 2 is rotated, the cam follower 39 rides on the cam 38 to raise the inside pusher roller 19 supported on the cam follower 39.

The operation of the mimeographic printing machine will now be described.

In the standby position of the machine shown in FIGS. 1 and 2, the claw 33 of the inside pusher lever 24 is in engagement with the hook 32 of the solenoid lever 31 so that the inside pusher roller 19 is kept in contact with the inner circumferential surface of the tubular wall 4. That is, the inside pusher roller 19 does not give a pushing force on the tubular wall 4. Then the cylindrical drum 2 and the lower pusher roller 10 are driven to rotate, in timed relation to which the delivery roller 15 is driven to supply a paper sheet 12.

Figure 3:
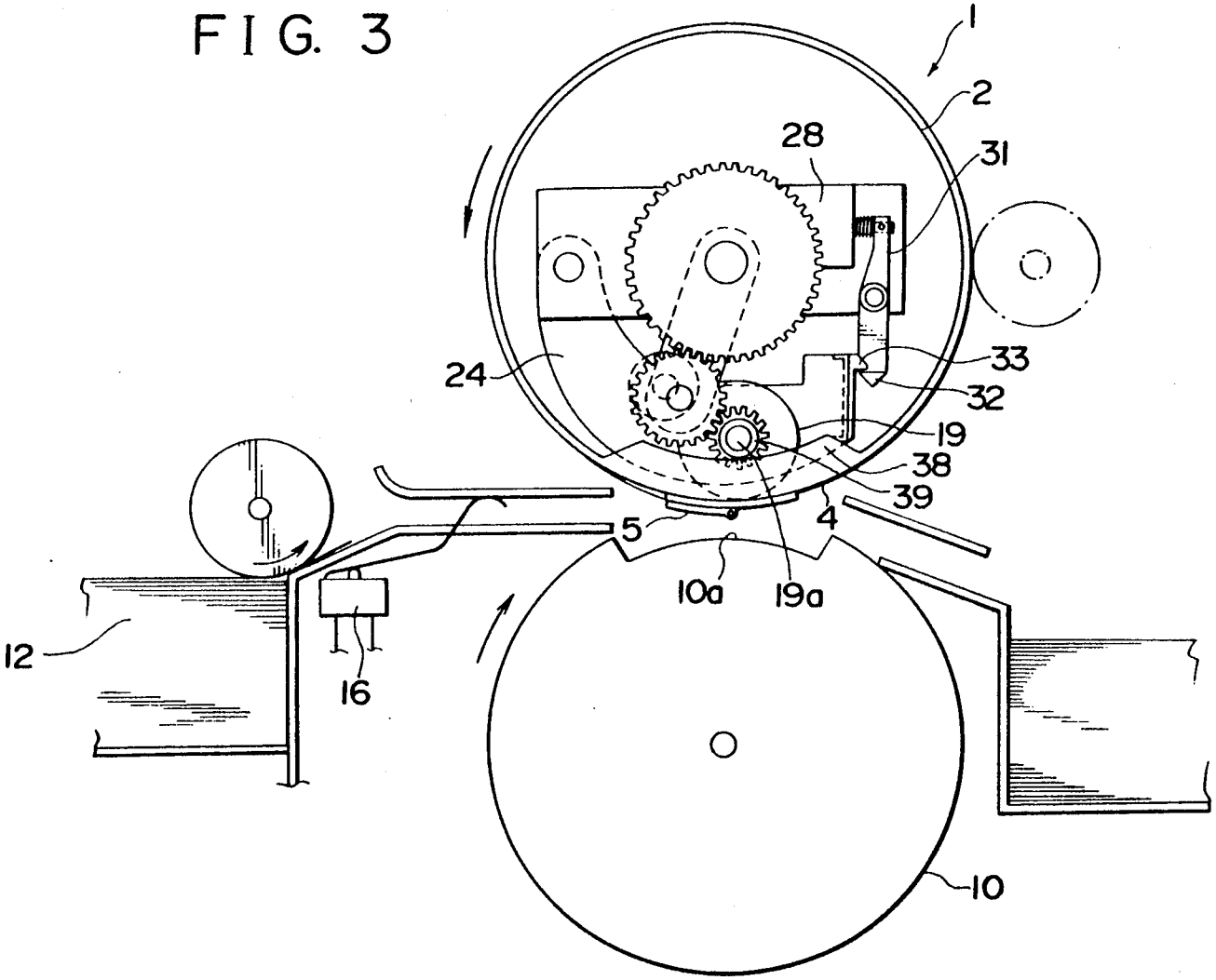
FIGS. 3 and 4 are cross-sectional views similar to FIG. 2, showing the mode of operation of the mimeographic printing machine.

When the clamp device 5 comes to the printing position as shown in FIG. 3, the cam follower 39 mounted on the drive shaft 19*a* of the inside pusher roller 19 rides on the cam 38. This riding causes both the inside pusher roller 19 and the inside pusher lever 24 to create a gap between the hook 32 of the solenoid lever 31 and the claw 33 of the inside pusher lever 24. Thus the load which was exerted on the solenoid lever 31 by, for example, the inside pusher roller 19 is removed.

Figure 4:
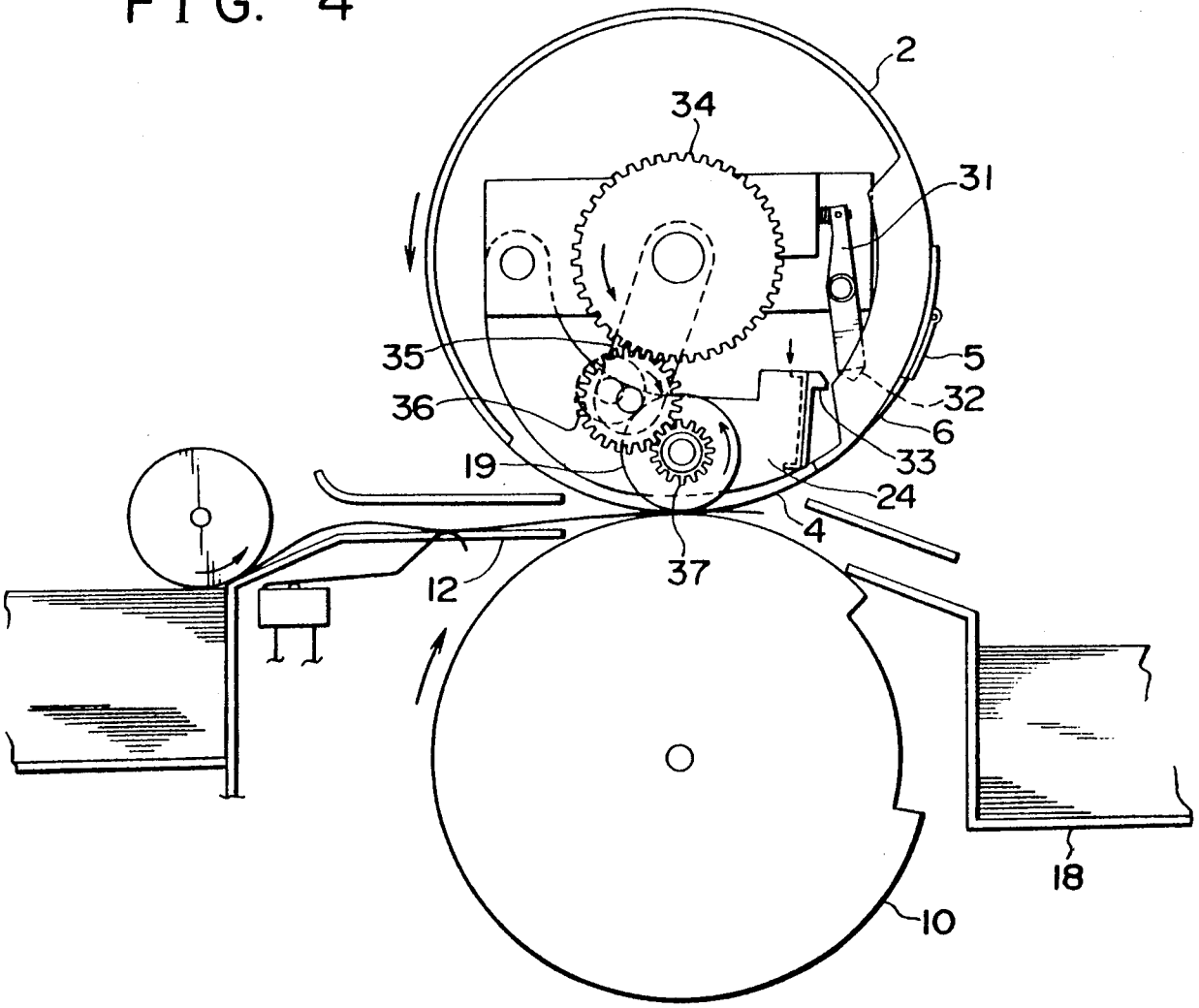
Figure 5:
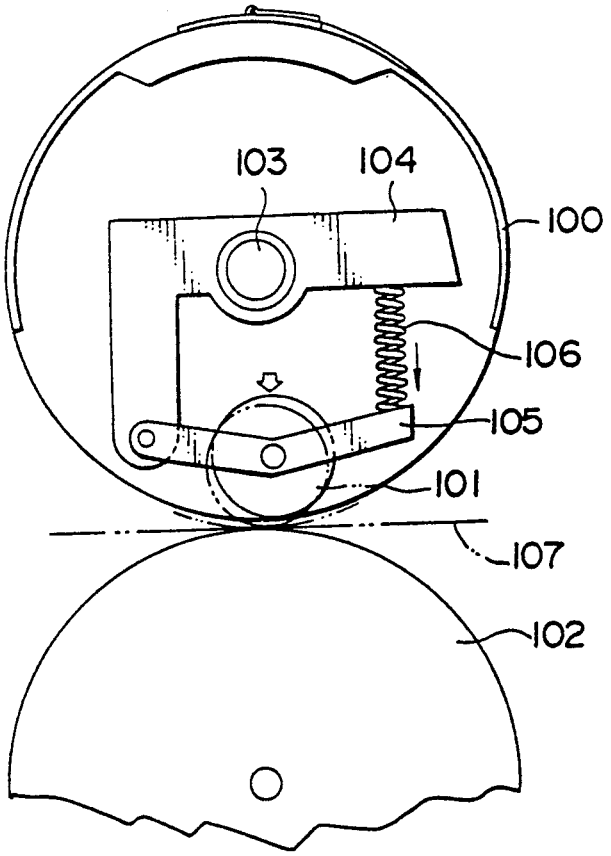
FIG. 5 Prior Art
FIG. 5 is a transverse cross-sectional view showing a typical prior art mimeographic printing machine.

Now when the detector switch 16 detects the supply of a paper sheet 12, the solenoid 28 is energized at a predetermined timing. At that time, since the solenoid lever 31 is subjected to no load, the hook 32 of the solenoid lever 31 is released from the claw 33 of the inside pusher lever 24 easily as shown in FIG. 4. The inside pusher roller 19 is pivotally moved downwardly to contact the inner circumferential surface of the tubular wall 4 so that the tubular wall 4 is pressed against the lower pusher roller 10 by the pusher mechanism.

As shown in FIG. 4, when the cylindrical drum 2 and the drive gear 34 are driven to rotate in a predetermined direction, the intermediate gear 36 meshing with the drive gear 34 is moved, with rotating on its own axis, in the rotating direction of the cylindrical drum 2 and the drive gear 34 along with the support arm 35. The thus moved intermediate gear 36 comes into meshing engagement with the inside pusher gear 37 to push the inside pusher gear 37 downwardly, with rotating. The insider pusher roller 19 operatively connected with the inside pusher gear 37 is rotated in the same direction as the cylindrical drum 2 to push the tubular wall 4 against the lower pusher roller 10 while deforming the tubular wall 4. Therefore the supplied paper sheet 12 is moved forwardly as held between the stencil 6 wound on the tubular wall 4 at a portion behind the clamp device 5 and the lower pusher roller 10, and a printed paper sheet is discharged onto the discharge tray 18.

According to this illustrated embodiment, since a pair of the pusher mechanisms each composed of a gear train pushes the inside pusher roller 19 against the inner circumferential surface by utilizing the rotating force of the cylindrical drum 2, the pushing force can be distributed uniformly in the axial direction of the inside pusher roller 19 so that any irregular density of print will hardly be created. Unlike the prior art mechanism utilizing the strong springs, it is unnecessary to strengthen the associated components or elements about the inside pusher roller, enabling the reduction of weight.

Further, since the inside pusher roller 19 to be pushed by the pusher mechanisms is retained in position by the lock device, the lowering of the inside pusher roller 19 is selectively allowed, only during printing, by the solenoid 28 as activated upon detection of the supply of a paper sheet.

If a trouble arises, for example, paper jamming occurred between the cylindrical drum 2 and the lower pusher roller 10, the inside pusher roller 19 is retained in the hollow of the cylindrical drum 2 by the lock device to be actuated by the solenoid 28. If the inside pusher roller 19 is thus kept out of contact with the inner circumferential surface of the cylindrical drum 2, ink will hardly come out on the outer circumferential surface of the cylindrical drum 2.

In the mimeographic printing machine of this invention, the inside pusher roller is pressed against the inner circumferential surface of the tubular wall by the gear trains operated in response to the rotation of the cylindrical drum. Therefore, it is possible to make the pushing force of the inside pusher roller uniform along the cylindrical drum so that any irregular density of print will hardly be created. Further, since no spring is used for the pushing means, it is simple in construction. Since the pushing force by the inside pusher roller acts on the cylindrical drum only during printing, it is unnecessary to strengthen the parts or elements around the inside pusher roller, thus reducing the weight as well as the cost of production.

What is claimed is:

1. A mimeographic printing machine comprising:

a frame:

a rotary cylindrical drum having outer and inner circumferential surfaces, said outer circumference surface being adapted to support a stencil thereon, and perforations for passage of ink, said cylindrical drum being rotatable on said frame with the stencil supported thereon;

ink supplying means situated inside said cylindrical drum;

a lower pusher roller rotatably supported on said frame under said cylindrical drum adapted to hold a paper sheet between said lower pusher roller and said cylindrical drum to move the paper sheet forwardly;

an inside pusher roller having a drive shaft, said inside pusher roller being movably retained in said cylindrical drum and contacting the inner circumferential surface of said cylindrical drum for pushing said cylindrical drum toward said lower pusher roller;

a drive gear driven for rotation together with said cylindrical drum;

a pivotable support arm disposed inside said cylindrical drum;

an intermediate gear mounted on said support arm and meshing with said drive gear, said intermediate gear being movable in a rotating direction of said drive gear in response to pivotal movement of said support arm; and an inside pusher gear mounted on the drive shaft of said inside pusher roller and meshing with said intermediate gear, said inside pusher roller being pushed, while rotating, against the inner circumferential surface of said cylindrical drum.

2. A mimeographic printing machine according to claim 1, further comprising a lock device for locking said inside pusher roller against movement such that said cylindrical drum and said lower pusher roller are out of contact with each other even when said inside pusher roller is in contact with the inner circumferential surface of said cylindrical drum, said lock device being releasable from the locking of said inside pusher roller during printing.

3. A mimeographic printing machine according to claim 2, wherein said lock device includes a latch lever and an inner pusher level attached to said inside pusher roller engageable with said lever to prevent said inside pusher roller from downward pivotal movement.

4. A mimeographic printing machine according to claim 3, further comprising:

a cam movable in response to rotation of said cylindrical drum; and a cam follower mounted on said drive shaft of said inside pusher roller and resting on said cam, said cam and said cam follower having a relationship such that during non-printing said cam raises said inside pusher roller via said cam follower to bring said inner pusher lever into and out of engagement with said latch lever.

5. A mimeographic printing machine according to claim 1, wherein said support arm is pivotally mounted on a center axis of said drive gear.

6. A mimeographic printing machine according to claim 2, further comprising means for detecting supply of the paper sheet to produce a detecting signal for allowing said lock device to release locking of said inside pusher roller.

7. A mimeographic printing machine according to claim 2, wherein when a trouble arises, said lock device is able to lock said inside pusher roller against movement so as not to contact the inner circumferential surface of said cylindrical drum.

* * * * *